US011041294B2

(12) United States Patent
Muellenbach

(10) Patent No.: US 11,041,294 B2
(45) Date of Patent: Jun. 22, 2021

(54) TOILET WITH HEATED WATER CLEANING SYSTEM

(71) Applicant: Kohler Co., Kohler, WI (US)

(72) Inventor: Keith E. Muellenbach, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 44 days.

(21) Appl. No.: 16/436,121

(22) Filed: Jun. 10, 2019

(65) Prior Publication Data

US 2019/0390450 A1 Dec. 26, 2019

Related U.S. Application Data

(60) Provisional application No. 62/688,527, filed on Jun. 22, 2018.

(51) Int. Cl.
*E03D 9/00* (2006.01)

(52) U.S. Cl.
CPC ..... *E03D 9/005* (2013.01)

(58) Field of Classification Search
CPC ..... E03D 9/002; E03D 9/005; E03D 9/08; E03D 9/085; E03D 9/12
See application file for complete search history.

(56) References Cited

U.S. PATENT DOCUMENTS 5,295,274 A * 3/1994 Daniels ..... A61M 3/0208 4/443

FOREIGN PATENT DOCUMENTS

| | | | | |
|---|---|---|---|---|
| CN | 2232460 | Y | | 8/1996 |
| CN | 202000452 | U | | 10/2011 |
| CN | 203080664 | U | | 7/2013 |
| CN | 203213256 | U | | 9/2013 |
| CN | 107338842 | A | * | 11/2017 |
| CN | 206637821 | U | * | 11/2017 |
| CN | 206637821 | U | | 11/2017 |
| KR | 20120014663 | A | | 2/2012 |
| WO | 9845542 | A1 | | 10/1998 |

OTHER PUBLICATIONS

Chinese Office Action for Chinese Application No. 201910541714.6 dated Jun. 24, 2020.

* cited by examiner

*Primary Examiner* — Erin Deery
(74) *Attorney, Agent, or Firm* — Lempia Summerfield Katz LLC

(57) ABSTRACT

A toilet includes a basin, a rim, and a heated water cleaning system. The basin includes a bowl. The rim includes a rim aperture in fluid communication with the bowl. The heated water cleaning system includes a heated water delivery channel and a heated water generator. The heated water delivery channel is positioned proximate the rim aperture. The heated water generator is in fluid communication with the heated water delivery channel. The heated water generator is configured to receive water, produce heated water, and provide the heated water to the heated water delivery channel. The heated water generator includes a heated water generator tank and a heater. The heated water generator tank is configured to contain at least one of water or heated water. The heater is positioned within the heated water generator tank.

19 Claims, 4 Drawing Sheets

TOILET WITH HEATED WATER CLEANING SYSTEM

CROSS-REFERENCE TO RELATED PATENT APPLICATION

The present application claims the benefit of, and priority to, U.S. Provisional Patent Application No. 62/688,527, filed Jun. 22, 2018, the contents of which are incorporated herein by reference in their entirety.

BACKGROUND

The present application relates generally to a toilet cleaning system. In particular, this application relates to a toilet with a heated water cleaning system.

Toilets receive waste (e.g., human waste, etc.) and provide the waste to a sewage system. Many toilets utilize water to initiate a flushing process for removing waste from the toilet and subsequently provide the water to the sewage system. The presence of waste and/or water can cause deposits (e.g., waste deposits, mold, etc.) to accumulate within the toilet. These deposits can cause a toilet to be undesirable. To mitigate formation of deposits, regular cleaning of toilets is typically conducted. However, it is difficult and/or unpleasant to adequately clean a toilet to substantially mitigate the formation of deposits on at least some portions of the toilet.

SUMMARY

One embodiment of the present disclosure is related to a toilet. The toilet includes a basin, a rim, and a heated water cleaning system. The basin includes a bowl. The rim includes a rim aperture in fluid communication with the bowl. The heated water cleaning system includes a heated water delivery channel and a heated water generator. The heated water delivery channel is positioned proximate the rim aperture. The heated water generator is in fluid communication with the heated water delivery channel. The heated water generator is configured to receive water, produce heated water, and provide the heated water to the heated water delivery channel. The heated water generator includes a heated water generator tank and a heater. The heated water generator tank is configured to contain at least one of water or heated water. The heater is positioned within the heated water generator tank.

Another embodiment of the present disclosure is related to a system for a toilet having a bowl and a rim, the rim having a rim aperture that is in fluid communication with the bowl and a heated water delivery channel positioned proximate the rim aperture. The system includes a heated water generator. The heated water generator is configured to be in fluid communication with the heated water delivery channel. The heated water generator is configured to receive water, produce heated water, and provide the heated water to the heated water delivery channel. The heated water generator includes a heated water generator tank and a heater. The heated water generator tank is configured to contain at least one of water or heated water. The heater is positioned within the heated water generator tank.

Yet another embodiment of the present disclosure is related to a toilet. The toilet includes a basin, a tank, a rim, and a heated water cleaning system. The basin includes a bowl. The rim includes a rim aperture that is in fluid communication with the bowl. The rim aperture is configured to receive water from the tank and provide the water from the tank into the bowl. The heated water cleaning system includes a heated water generator tank and a heated water delivery channel. The heated water generator tank is configured to contain water separate from the tank. The heated water delivery channel is positioned proximate the rim aperture and in fluid communication with the rim aperture. The heated water delivery channel is configured to provide water from the heated water generator tank to the rim aperture. The rim aperture is configured to receive the water from the heated water delivery channel and provide the water from the heated water delivery channel into the bowl.

It is to be understood that both the foregoing general description and the following detailed description are exemplary and explanatory only and are not restrictive of the invention as claimed.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

I. Overview

A toilet may accumulate deposits on various internal surfaces. These deposits may include waste deposits as well as mold. These deposits can produce unpleasant odors and can make using, or being in close proximity to, the toilet undesirable. As a result, attempts are often made to clean these deposits using a toilet brush or other cleaning device. Unfortunately, it is typically difficult to adequately remove these deposits, and a toilet may require routine cleaning in order to mitigate the accumulation of such deposits.

Various embodiments herein relate to a heated water cleaning system for a toilet. The heated water cleaning system generates heated water (e.g., steam, hot liquid water, steam and hot liquid water, etc.) and routes the heated water to the toilet. When the heated water contacts surfaces within the toilet, the heated water may sanitize these surfaces due to the relatively high temperature of heated water. This sanitization can subsequently reduce odors emitted from deposits. Additionally, the heated water may cause removal of deposits due to the condensation of the heated water along the surfaces of the toilet and the downward flow of condensed water. This downward flow may loosen or remove deposits from these surfaces. In this way, the heated water cleaning system facilitates cleaning of otherwise difficult to clean surfaces of a toilet, thereby making the toilet more desirable.

Figure 1:
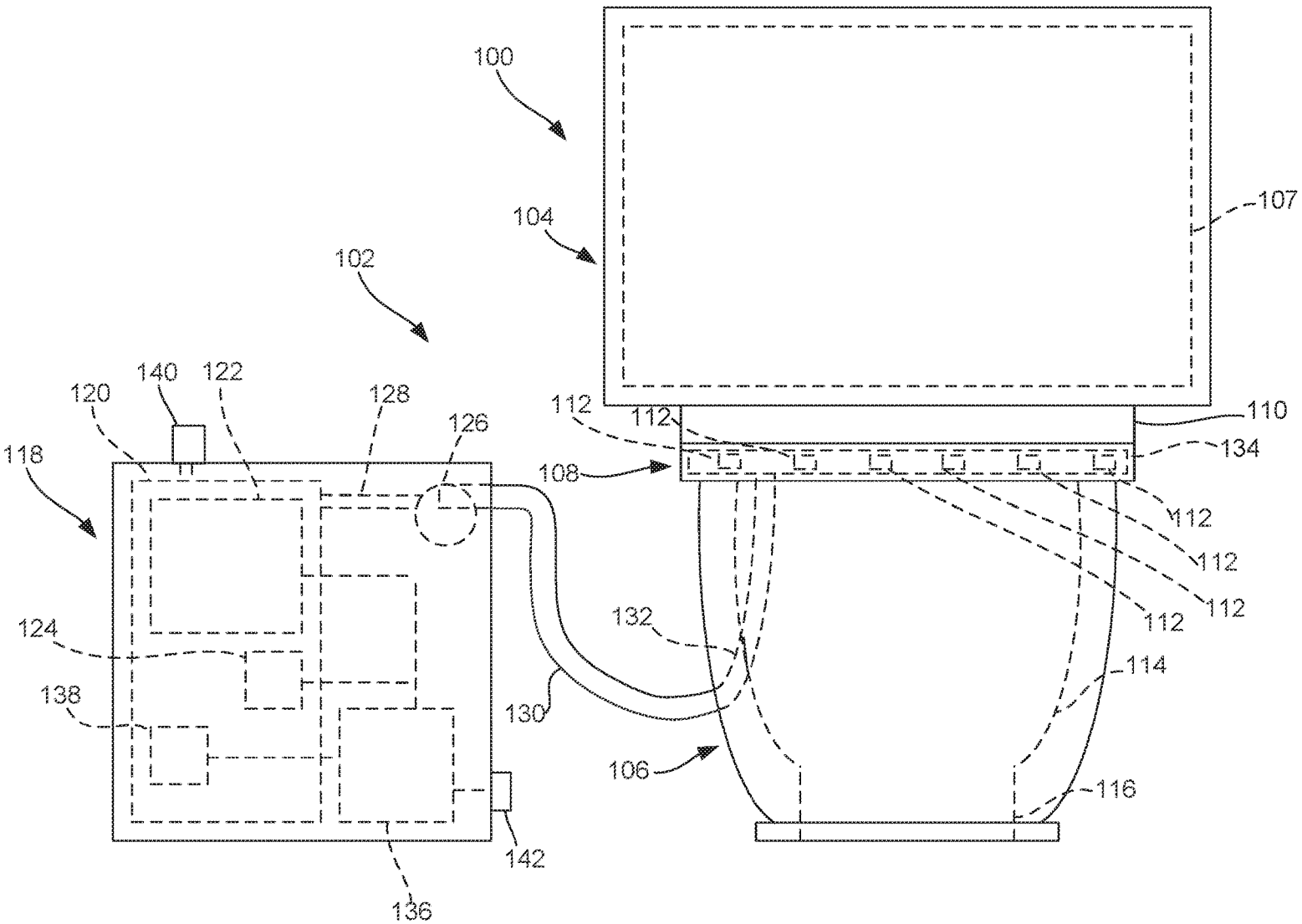
FIG. 1 is a block diagram of a toilet having a heated water cleaning system, according to an exemplary embodiment of the present disclosure.

II. The Toilet Having a Heated Water Cleaning System According to a First Embodiment Referring to FIG. 1, a toilet 100 (e.g., commode, tankless toilet, tank toilet, Flushometer toilet, gravity feed toilet, pressure assisted toilet, dual-flush toilet, double-cyclone toilet, residential toilet, commercial toilet, industrial toilet, etc.) and a heated water cleaning system 102 (e.g., toilet cleaning system, automatic toilet cleaning system, etc.) are shown, according to an exemplary embodiment. The toilet 100 selectively receives waste (e.g., urine, feces, etc.) from a user (e.g., human, etc.) and selectively provides the waste to a sewage system (e.g., septic system, etc.). The toilet 100 may be installed in a user's home and/or in a commercial application, such as in a commercial building (e.g., office building, mall, etc.) or an industrial building.

As will be explained in more detail herein, the heated water cleaning system 102 is configured to generate heated water (e.g., steam, hot liquid water, steam and hot liquid water, etc.) and to route that heated water to portions of the toilet 100. When the heated water contacts the toilet 100, the heated water may sterilize the toilet 100 (e.g., by killing germs, etc.) and may dislodge deposits (e.g., waste deposits, etc.) which formed on the toilet such that the deposits can be easily flushed out of the toilet 100. In this way, the heated water cleaning system 102 simplifies cleaning of the toilet 100 and provides a level of cleaning that is difficult and/or unpleasant to obtain without the heated water cleaning system 102. For example, without the heated water cleaning system 102, a user may have to manually scrub hard-to-reach areas of the toilet 100 and still may be unable to dislodge deposits without vigorous scrubbing. Additionally, other cleaning devices, which do not generate heated water, may also be unable to clean hard-to-reach areas that can be reached by heated water and are unable to obtain the dual benefit of the heated water cleaning system 102 of using the heated water to disinfect surfaces (e.g., due to the temperature of the heated water, etc.) and, where at least a portion of the heated water is steam, of using condensed steam to dislodge and/or soften deposits on the toilet 100. Furthermore, the heated water cleaning system 102 can be utilized with only water and does not require special cleaners to clean the toilet, thereby providing a user with flexibility realize reduced operating costs compared to other cleaning devices.

The toilet 100 includes a tank 104 and a basin 106. The tank 104 is supported on the basin 106 which is supported on a surface (e.g., floor, ground, tile floor, etc.). The tank 104 includes a tank water supply 107. The tank water supply 107 is configured to store water for flushing the toilet 100. While not shown, it is understood that the toilet 100 also includes float and various hardware (e.g., valves, seals, pipes, etc.) configured to facilitate flushing of the toilet 100 using the water from the tank water supply 107. The tank water supply 107 is configured to selectively receive water from a water supply conduit (e.g., water supply pipe, water main, etc.).

The toilet 100 also includes a rim 108 and a toilet seat 110. The rim 108 is coupled to and contiguous with the basin 106. The rim 108 has an ovoid (e.g., elliptical, etc.) shape and extends beyond (e.g., hangs over, etc.) the basin 106. The toilet seat 110 rests upon and may be rotatably coupled to the rim 108. The toilet seat 110 may include a toilet seat lid.

The rim 108 includes a plurality of rim apertures 112. Each of the rim apertures 112 is positioned within the rim 108 and may be positioned underneath an overhang such that the rim apertures 112 are substantially hidden from a user looking down (e.g., towards the ground, etc.) into the rim 108. Each of the rim apertures 112 receives water from the tank water supply 107 when the toilet 100 is flushed. The rim apertures 112 may be disposed at least partially about the rim 108. For example, the rim 108 may include a plurality of rim apertures 112 interspaced about the rim 108 at regular intervals (e.g., at a regular spacing from one another, etc.).

The basin 106 includes a bowl 114. The bowl 114 is configured to receive water from the rim apertures 112 when the toilet 100 is flushed. Specifically, flushing of the toilet 100 causes water to be provided from the tank water supply 107 to the rim apertures 112 and into the bowl 114. From the bowl 114, the water is further provided to an outlet 116. The outlet 116 may provide the water to a siphon and/or sewage connection. The bowl 114 may be configured to contain an amount of water (e.g., a water seal, etc.) such that waste is deposited into the amount of water, the amount of water drains via the outlet 116 when the toilet 100 is flushed and the bowl 114 is subsequently refilled with water.

The heated water cleaning system 102 includes a heated water generator 118. In an exemplary embodiment, the heated water generator 118 is positioned external to the toilet 100. For example, the heated water generator 118 may be positioned next to the toilet 100 (e.g., alongside of the toilet 100, behind the toilet 100, etc.). In other applications, the heated water generator 118 may be positioned within a wall proximate the toilet 100 such that the heated water generator 118 is substantially hidden (e.g., concealed, etc.) in the wall. However, in other applications, the heated water generator 118 is positioned at least partially inside of the toilet 100. In these embodiments, the heated water generator 118 is maintained separate from water used to flush the toilet (e.g., water in the tank water supply 107, etc.).

The heated water generator 118 includes a heated water generator tank 120. The heated water generator tank 120 is configured to selectively receive water from a water supply conduit and to store the water therein. The water supply conduit that provides water to the heated water generator tank 120 may be the same as the water supply conduit which provides water the tank water supply 107.

The heated water generator 118 includes a water heater 122. The water heater 122 may be an electric heating element (e.g., a resistance heater, metal heating element, ceramic heating element, polymer heating element, composite heating element, etc.). The water heater 122 is configured to heat the water stored in the heated water generator tank 120 to generate heated water.

The heated water generator 118 includes a sensor 124 positioned within the heated water generator tank 120. The sensor 124 is configured to sense (e.g., measure, monitor, determine, etc.) a parameter (e.g., temperature, pressure, quality, humidity, volume, etc.) within the heated water generator tank 120. For example, the sensor 124 may determine a temperature of the water within the heated water generator tank 120. Instead of, or in addition to, sensing the water in the heated water generator tank 120, the sensor 124 may determine a parameter of the heated water generated by the water heater 122. For example, the sensor 124 may determine a pressure of the steam within the heated water generator tank 120. The sensor 124 may include a plurality of sensors, each of the plurality of sensors configured to sense a different parameter such that the heated water cleaning system 102 may be tailored for a target application.

The heated water generator 118 also includes a pump 126 (e.g., rotary pump, centrifugal pump, positive displacement pump, etc.). The pump 126 is configured to selectively draw heated water from the heated water generator tank 120 through a first conduit 128 extending within the heated water generator 118. The pump 126 is configured to selectively provide heated water to a second conduit 130. The second conduit 130 extends between the heated water generator 118 and the toilet 100. In this way, the second conduit 130 facilitates location of the heated water generator 118 remote from the toilet 100, such as within a closet or behind a wall. The second conduit 130 provides the heated water received from the pump 126 to a third conduit 132. The third conduit 132 extends within the toilet 100, such as within the basin 106. In some embodiments, the heated water generator 118 includes a flush valve (e.g., solenoid valve, etc.) instead of, or in addition to, the pump 126. In these embodiments, the heated water generator tank 120 may be positioned above at least a portion of the toilet 100 such that by opening the flush valve, water is provided from the heated water generator tank 120 to the toilet 100 (e.g., due to gravity, etc.) with or without assistance provided by the pump 126.

The toilet 100 includes a heated water delivery channel 134. The heated water delivery channel 134 extends about the rim 108. In various embodiments, the heated water delivery channel 134 extends about the rim 108 proximate each of the rim apertures 112. The heated water delivery channel 134 is configured to deliver the heated water from the heated water generator 118 to clean the toilet 100. In particular, the heated water delivery channel 134 may be configured to deliver the heated water underneath the rim 108 and within the rim apertures 112. Contact between the heated water and the toilet 100 may sterilize the toilet 100 to kill germs associated with deposits (e.g., water deposits, waste deposits, mold, etc.) in the toilet. Additionally, where at least a portion of the heated water is steam, as the steam delivered to the toilet 100 condenses, the condensed steam may wash deposits into the bowl 114. In this way, the heated water cleaning system 102 may be utilized to mitigate accumulation of deposits within the toilet 100, thereby making the toilet 100 more desirable than other toilets which do not include the heated water cleaning system 102 and instead require manual cleaning or cannot be readily cleaned using only heated water.

The heated water generator 118 also includes a controller 136. The controller 136 is communicable with the water heater 122, the sensor 124, and the pump 126. The controller 136 is configured to receive the parameter sensed by the sensor 124 and to control the water heater 122 and the pump 126 based on the parameter. For example, the controller 136 may compare the temperature of water within the heated water generator tank 120 to a boiling point of water and control the water heater 122 based on the temperature of the water within the heated water generator tank 120 (e.g., if the temperature of the water within the heated water generator tank 120 is significantly below the boiling point of water, then the controller 136 may cause the water heater 122 to heat the water at a greater rate than if the temperature of the water within the heated water generator tank 120 is not significantly below the boiling point of water, etc.).

The heated water generator 118 also includes a fill valve 138 which is communicable with the controller 136. The fill valve 138 is communicable with the water supply conduit that provides water to the heated water generator tank 120 and is configured to be controlled by the controller 136 to selectively fill the heated water generator tank 120 with water. For example, when the sensor 124 determines that a level of the water within the heated water generator tank 120 is below a threshold (e.g., a minimum amount of water within the heated water generator tank 120, etc.) the controller 136 may open the fill valve 138 until the level of the water within the heated water generator tank 120 is at or above the threshold.

The heated water generator 118 is defined by a heated water cleaning cycle. In some embodiments, the heated water cleaning cycle includes: turning on (e.g., activating, powering, starting, etc.) the water heater 122 to heat (e.g., boil, etc.) the water to produce heated water; using the sensor 124 to determine when a target amount of heated water is present within the heated water generator tank 120; turning on the pump 126 such that the heated water is provided to the heated water delivery channel 134 for a target period of time (e.g., a cleaning time, etc.); turning off (e.g., deactivating, powering-off, shutting down, etc.) the pump 126; turning off the water heater 122, opening the fill valve 138 to fill the heated water generator tank 120 with water such that a target amount of water is present within the heated water generator tank 120, as determined by using the sensor 124; and closing the fill valve 138. These embodiments may be referred to as "initially filled" heated water cleaning cycles because the first step is not opening the fill valve 138 to cause water to fill the heated water generator tank 120. In other embodiments, the heated water cleaning cycle include: opening the fill valve 138 to fill the heated water generator tank 120 with water such that a target amount of water is present within the heated water generator tank 120, as determined by using the sensor 124; closing the fill valve 138; turning on the water heater 122 to heat the water such that the water is boiled to produce heated water; using the sensor 124 to determine when a target amount of heated water is present within the heated water generator tank 120; turning on the pump 126 such that the heated water is provided to the heated water delivery channel 134 for a target period of time; turning off the pump 126; and turning off the water heater 122. These embodiments may be referred to as "initially empty" heated water cleaning cycles because the first step is opening the fill valve 138 to cause water to fill the heated water generator tank 120. If the heated water generator 118 includes a flush valve instead of, or in addition to, the pump 126, the heated water cleaning cycle may include opening the flush valve to provide the heated water to the heated water delivery channel 134 (e.g., instead of turning on the pump 126 to the heated water delivery channel 134, etc.).

The heated water generator 118 also includes a pressure relief valve (PRV) 140. The PRV 140 is communicable with the heated water generator tank 120 and is configured to substantially prevent over pressurization of the heated water generator tank 120. For example, when a pressure of the heated water within the heated water generator tank 120 exceeds a threshold, the PRV 140 may purge heated water from the heated water generator tank 120 (e.g., release steam from the heated water generator tank 120 to atmosphere, etc.) until the pressure of the heated water within the heated water generator tank 120 is at or below the threshold. The PRV 140 may be communicable with an alarm that is configured to alert a user (e.g., via a whistle, via an indicator light, via a warning signal, via an audio signal, etc.) of a potential fault within the heated water generator 118 that could result in unintentional pressurization of the heated water generator tank 120.

The heated water generator 118 also includes an input/output device 142 that is communicable with the controller 136. The input/output device 142 may be a keypad, a touchscreen, a wired communication port (e.g., a universal serial bus (USB) port, etc.), a wireless communication device (e.g., a Bluetooth transceiver, a Bluetooth receiver, a near-field communication (NFC) transceiver, an NFC receiver, a Wi-Fi transceiver, a Wi-Fi receiver, etc.), or other similar device. The input/output device 142 is configured to facilitate user interaction with the controller 136 (e.g., via a smartphone, via a laptop, via the internet, via manual interaction with the input/output device 142, etc.). In some embodiments, the input/output device 142 includes a button which may be depressed to initiate a heated water cleaning cycle (e.g., independent of any scheduled heated water cleaning cycles, etc.). In some embodiments, the input/output device 142 is located on the toilet 100 (e.g., on the tank 104, etc.) or remote from both the toilet 100 and the heated water generator 118 (e.g., on a wall, on a mirror, etc.).

In various embodiments, the controller 136 facilitates scheduling cleaning of the toilet 100 using the heated water cleaning system 102. For example, the controller 136 may specify that the toilet 100 is to complete a heated water cleaning cycle (e.g., an initially filled heated water cleaning cycle, an initially empty heated water cleaning cycle, etc.) every so often (e.g., every week, every month, etc.). The input/output device 142 may be utilized by a user to specify that each day, at a target time (e.g., two o'clock in the morning, etc.), the controller 136 is to initiate a heated water cleaning cycle. In this way, the user may ensure that the toilet 100 is cleaned at time when usage of the toilet is not expected. A user may utilize the input/output device 142 to determine when the heated water cleaning system 102 cleans the toilet 100, how much heated water is utilized to clean the toilet 100 (e.g., the user can select to utilize the "maximum" amount of heated water, the "minimum" amount of heated water, and other similar amounts, etc.), and other similar options.

In some embodiments, the controller 136 can control the water heater 122 such that the heated water provided to the toilet 100 has a target temperature. For example, it may desirable to clean the toilet 100 using higher temperature heated water every so often while cleaning the toilet 100 using lower temperature heated water at all other times, thus allowing the heated water cleaning system 102 to operate in an energy-efficient manner. For example, the controller 136 may alternate heated water cleaning cycles between a heated water cleaning cycle using higher temperature heated water and a heated water cleaning cycle using lower temperature heated water.

While not shown, it is understood that the controller 136 receives electricity (e.g., electrical power, electrical energy, etc.) from a source. For example, the controller 136 may be connected to a wall outlet (e.g., a 120 Volt alternating current (AC) outlet, etc.). In some embodiments, the heated water generator 118 includes a backup battery. The backup battery is configured to receive electricity from the source and to store the electricity for use by the heated water generator 118 in the event of a power outage at the source.

While not shown, the controller 136 may communicate with a sensor that is configured to determine a parameter associated with the toilet 100, rather than the sensor 124 which senses a parameter associated with the heated water generator 118. For example, the controller 136 may be communicable with an occupancy sensor, motion sensor, or infrared sensor that is configured to determine if a user is using the toilet 100. If the controller 136 determines that a user is using the toilet 100, the controller 136 may delay a heated water cleaning cycle (e.g., a previously scheduled heated water cleaning cycle, etc.) until a target period of time has elapsed since the controller 136 has determined the user is no longer using the toilet 100. In this way, the controller 136 may minimize the likelihood that a user will encounter heated water from the heated water cleaning system 102.

In some embodiments, the heated water generator 118 is configured to receive a treatment for treating the heated water produced by the heated water generator 118 prior to the heated water being provided to the toilet 100. For example, the heated water generator 118 may receive a scented treatment such that the heated water provided to the toilet provides a scent to the toilet 100. This scent may also impact air surrounding the toilet 100. In this way, the heated water generator 118 may provide an added functionality of providing the toilet 100 with a target aromatic enhancement. In other applications, the treatment may be a target cleaning agent. The target cleaning agent may be, for example, an anti-bacterial treatment that provides the heated water with additional anti-bacterial properties. In still other embodiments, the treatment may include a dye that is dispersed within the heated water such that when the heated water flows into the bowl 114, the dye colors the water within the bowl 114 (e.g., to leave a "recently cleaned" visual appearance, etc.). The treatment may be provided to the heated water generator 118 in the form of a capsule that is inserted into the heated water generator 118 (e.g., via a cartridge, etc.). In this way, different capsules could be purchased by a user and inserted in the heated water generator 118 to provide the heated water generator 118 with a target functionality. The heated water generator 118 may also include a separate tank for storing the treatment and mixing the treatment with the heated water (e.g., downstream of the pump 126 but upstream of the second conduit 130, etc.).

In some embodiments, the controller 136 is configured to selectively operate the heated water generator 118 as a humidifier to humidify a room within which the heated water generator 118 is located. For example, the controller 136 may be configured to maintain a humidity within the room by generating steam and purging the steam to the room using the PRV 140. In these embodiments, the controller 136 may include an additional sensor for monitoring the humidity of the room. In some embodiments, the controller 136 is configured to selectively operate the heated water generator 118 to produce steam for warming towels. For example, the controller 136 may be scheduled to warm a towel or a plurality of towels every morning such that when a user uses a towel after a shower or bath, the towel has been warmed by the steam.

While not shown, it is understood that the heated water generator 118 may include various check valves to prevent backflow of air and/or fluid from the toilet 100 into the heated water generator 118. The heated water generator 118 may also include various filters (e.g., air filters, water filters, etc.) to ensure prolonged operation of the heated water cleaning system 102 with minimal maintenance.

While the toilet 100 has been primarily described and illustrated as a toilet which utilizes a water flush, it is understood that the heated water cleaning system 102 could be similarly implemented in waterless and low water toilets. In some embodiments, the pump 126 is replaced with a valve (e.g., discharge valve, etc.) that is communicable with the controller 136 and configured to be selectively opened and closed by the controller 136 to facilitate the flow of heated water from the first conduit 128 to the second conduit 130 (e.g., due to a greater pressure within the heated water generator tank 120 than at the heated water delivery channel 134, etc.).

Figure 2:
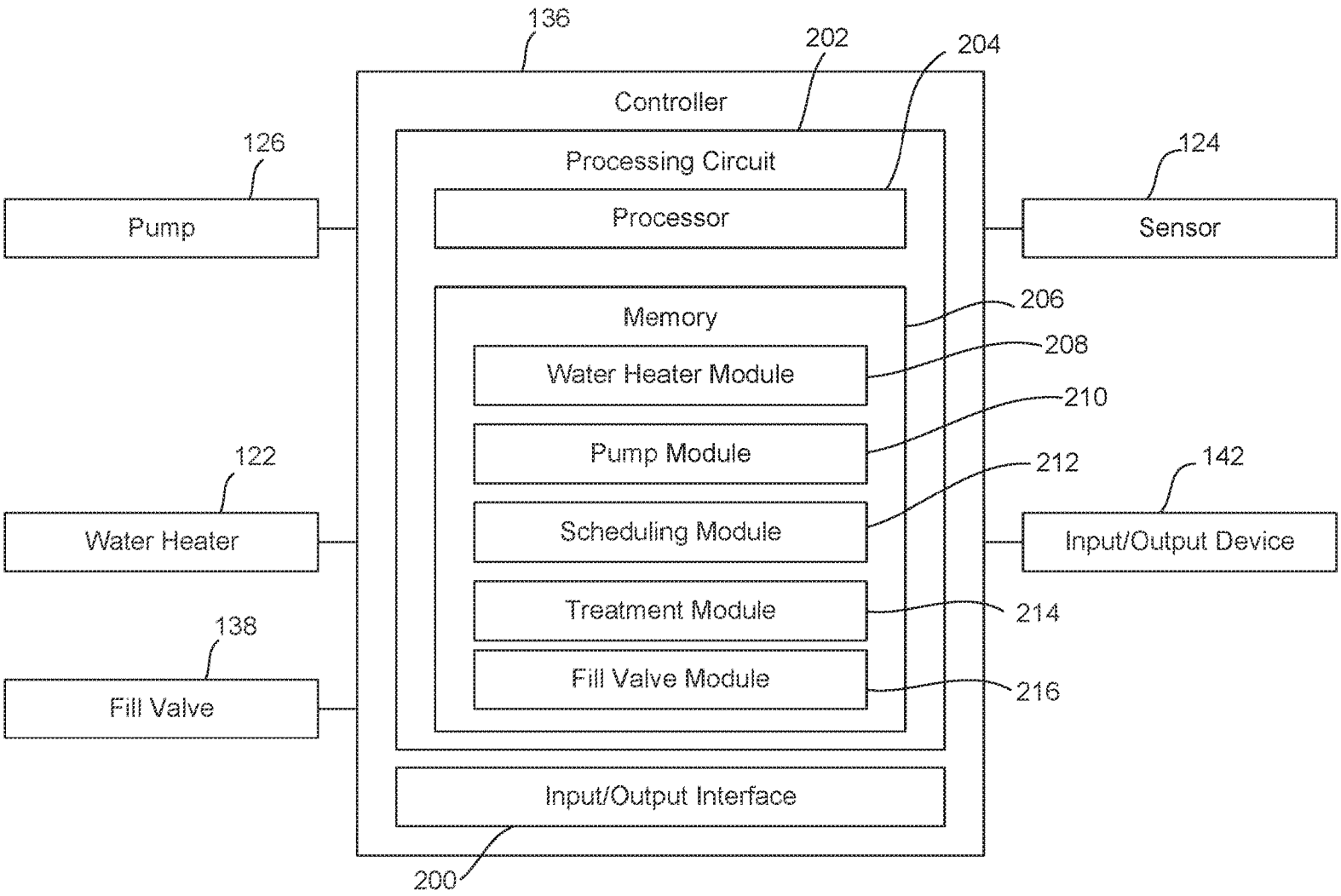
FIG. 2 is a block diagram of a control system for the heated water cleaning system shown in FIG. 1, according to an exemplary embodiment of the present disclosure.

FIG. 2 illustrates the controller 136 in greater detail. The controller 136 is electronically communicable with the water heater 122, the sensor 124, the pump 126, the fill valve 138, and the input/output device 142. The controller 136 is configured to control the water heater 122, the sensor 124, the pump 126, and the fill valve 138 to complete a heated water cleaning cycle, such as in response to a request for a heated water cleaning cycle received by the input/output device 142.

The controller 136 includes an input/output (I/O) interface 200 and a processing circuit 202. The input/output interface 200 facilitates interaction between the processing circuit 202 and the water heater 122, the sensor 124, the pump 126, the fill valve 138, and the input/output device 142. The processing circuit 202 includes a processor 204 and a memory 206. The memory 206 may include, but is not limited to, electronic, optical, magnetic, or any other storage or transmission device capable of providing the processor 204 with program instructions. The memory 206 may include a memory chip, electrically erasable programmable read-only memory, erasable programmable read only memory, flash memory, or any other suitable memory from which the modules can read instructions. The instructions may include code from any suitable programming language.

The memory 206 includes a number of modules (e.g., microprocessors, application-specific integrated circuit, field-programmable gate arrays, etc.). As shown in FIG. 2, the memory 206 includes a water heater module 208, a pump module 210, a scheduling module 212, a treatment module 214, and a fill valve module 216. The water heater module 208 is configured to control interactions between the controller 136 and the water heater 122. The pump module 210 is configured to control interactions between the controller 136 and the pump 126. The scheduling module 212 is configured to control interactions between the controller 136 and the input/output device 142. The treatment module 214 is configured to facilitate interaction between the controller 136 and any device of the heated water generator 118 which receives a cartridge having a treatment contained therein. The fill valve module 216 is configured to control interactions between the controller 136 and the fill valve 138.

Figure 3:
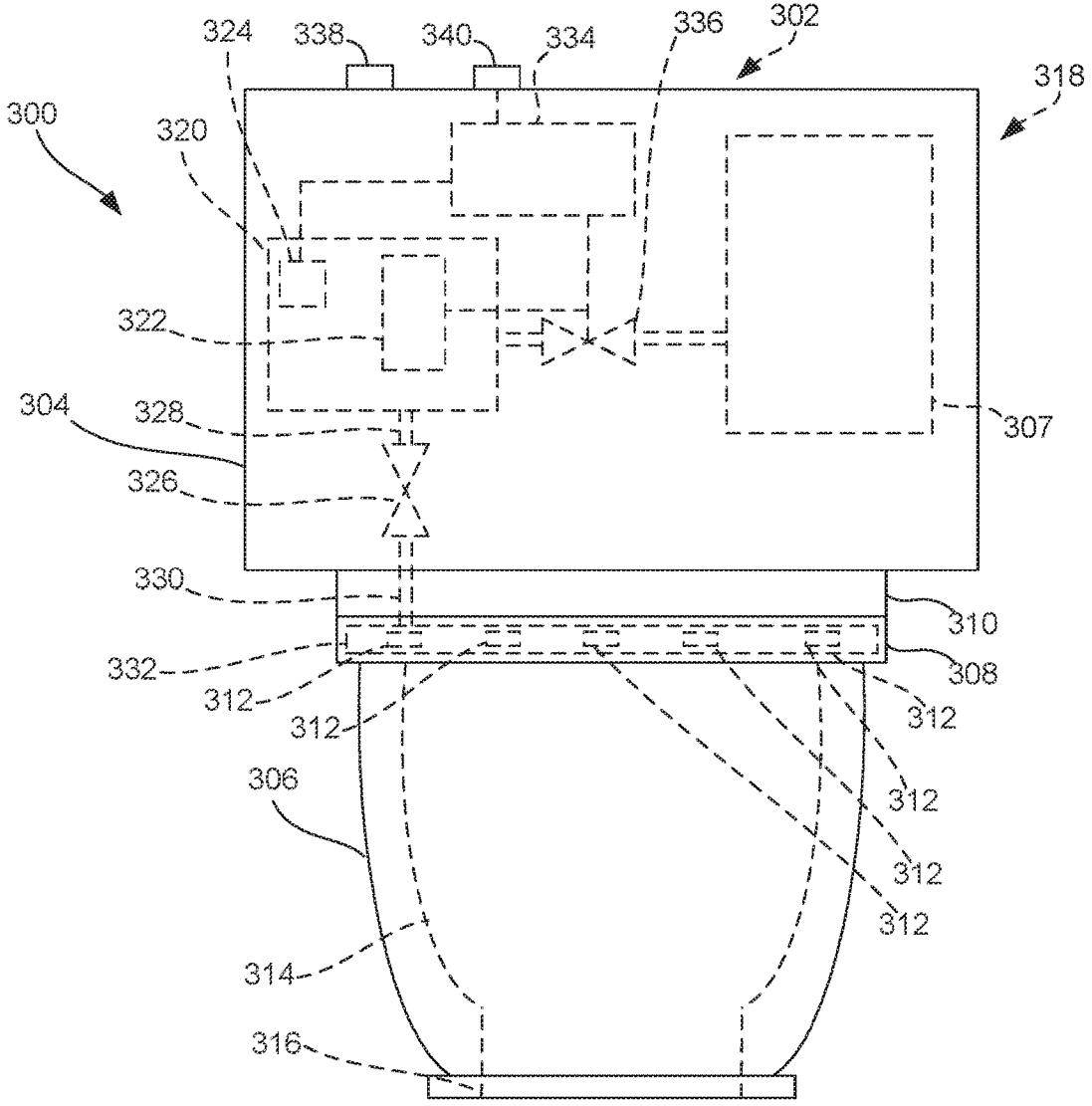
FIG. 3 is a block diagram of a toilet having another heated water cleaning system, according to an exemplary embodiment of the present disclosure.

III. The Toilet Having a Heated Water Cleaning System According to a Second Embodiment Referring to FIG. 3, a toilet 300 (e.g., commode, tankless toilet, tank toilet, Flushometer toilet, gravity feed toilet, pressure assisted toilet, dual-flush toilet, double-cyclone toilet, residential toilet, commercial toilet, industrial toilet, etc.) and a heated water cleaning system 302 (e.g., toilet cleaning system, automatic toilet cleaning system, etc.) are shown, according to an exemplary embodiment. The toilet 300 selectively receives waste (e.g., urine, feces, etc.) from a user (e.g., human, etc.) and selectively provides the waste to a sewage system (e.g., septic system, etc.). The toilet 300 may be installed in a user's home and/or in a commercial application, such as in a commercial building (e.g., office building, mall, etc.) or an industrial building.

As will be explained in more detail herein, the heated water cleaning system 302 is configured to generate heated water and to route that heated water to portions of the toilet 300. When the heated water contacts the toilet 300, the heated water may sterilize the toilet 300 (e.g., by killing germs, etc.) and may dislodge deposits (e.g., waste deposits, etc.) which formed on the toilet such that the deposits can be easily flushed out of the toilet 300. In this way, the heated water cleaning system 302 simplifies cleaning of the toilet 300 and provides a level of cleaning that is difficult and/or unpleasant to obtain without the heated water cleaning system 302. For example, without the heated water cleaning system 302, a user may have to manually scrub hard-to-reach areas of the toilet 300 and still may be unable to dislodge deposits without vigorous scrubbing. Additionally, other cleaning devices, which do not generate heated water, may also be unable to clean hard-to-reach areas that can be reached by heated water and are unable to obtain the dual benefit of the heated water cleaning system 302 of using the heated water to disinfect surfaces (e.g., due to the temperature of the heated water, etc.) and of using condensed heated water to dislodge and/or soften deposits on the toilet 300. Furthermore, the heated water cleaning system 302 can be utilized with only water and does not require special cleaners to clean the toilet, thereby providing a user with flexibility realize reduced operating costs compared to other cleaning devices.

The toilet 300 includes a tank 304 and a basin 306. The tank 304 is supported on the basin 306 which is supported on a surface (e.g., floor, ground, tile floor, etc.). The tank 304 includes a tank water supply 307. The tank water supply 307 is configured to store water for flushing the toilet 300. While not shown, it is understood that the toilet 300 also includes float and various hardware (e.g., valves, seals, pipes, etc.) configured to facilitate flushing of the toilet 300 using the water from the tank water supply 307. The tank water supply 307 is configured to selectively receive water from a water supply conduit (e.g., water supply pipe, water main, etc.).

The toilet 300 also includes a rim 308 and a toilet seat 310. The rim 308 is coupled to and contiguous with the basin 306. The rim 308 has an ovoid (e.g., elliptical, etc.) shape and extends beyond (e.g., hangs over, etc.) the basin 306. The toilet seat 310 rests upon and may be rotatably coupled to the rim 308. The toilet seat 310 may include a toilet seat lid.

The rim 308 includes a plurality of rim apertures 312. Each of the rim apertures 312 is positioned within the rim 308 and may be positioned underneath an overhang such that the rim apertures 312 are substantially hidden from a user looking down (e.g., towards the ground, etc.) into the rim 308. Each of the rim apertures 312 receives water from the tank water supply 307 when the toilet 300 is flushed. The rim apertures 312 may be disposed at least partially about the rim 308. For example, the rim 308 may include a plurality of rim apertures 312 interspaced about the rim 308 at regular intervals (e.g., at a regular spacing from one another, etc.).

The basin 306 includes a bowl 314. The bowl 314 is configured to receive water from the rim apertures 312 when the toilet 300 is flushed. Specifically, flushing of the toilet 300 causes water to be provided from the tank water supply 307 to the rim apertures 312 and into the bowl 314. From the bowl 314, the water is further provided to an outlet 316. The outlet 316 may provide the water to a siphon and/or sewage connection. The bowl 314 may be configured to contain an amount of water (e.g., a water seal, etc.) such that waste is deposited into the amount of water, the amount of water drains via the outlet 316 when the toilet 300 is flushed, and the bowl 314 is subsequently refilled with water.

The heated water cleaning system 302 includes a heated water generator 318. The heated water generator 318 is positioned inside the tank 304 and is not positioned external to the tank 304. The heated water generator 318 includes a heated water generator tank 320. In an exemplary embodiment, the heated water generator tank 320 is configured to selectively receive water from the tank water supply 307. However, in other embodiments, the heated water generator tank 320 is configured to receive water from a water supply conduit, such as the water supply conduit that provides water the tank water supply 307.

The heated water generator 318 includes a water heater 322. The water heater 322 may be an electric heating element (e.g., a resistance heater, metal heating element, ceramic heating element, polymer heating element, composite heating element, etc.). The water heater 322 is configured to heat the water stored in the heated water generator tank 320 to generate heated water.

The heated water generator 318 includes a sensor 324 positioned within the heated water generator tank 320. The sensor 324 is configured to sense (e.g., measure, monitor, determine, etc.) a parameter (e.g., temperature, pressure, quality, humidity, volume, etc.) within the heated water generator tank 320. For example, the sensor 324 may determine a temperature of the water within the heated water generator tank 320. Instead of, or in addition to, sensing the water in the heated water generator tank 320, the sensor 324 may determine a parameter of the heated water generated by the water heater 322. For example, the sensor 324 may determine a pressure of the heated water within the heated water generator tank 320. The sensor 324 may include a plurality of sensors, each of the plurality sensors being configured to sense a different parameter such that the heated water cleaning system 302 may be tailored for a target application.

The heated water generator 318 also includes a discharge valve 326 (e.g., solenoid valve, electronically controllable valve, etc.). The discharge valve 326 is configured to selectively draw heated water from the heated water generator tank 320 through a first conduit 328 extending within the heated water generator 318. The discharge valve 326 is configured to selectively provide heated water to a second conduit 330. The second conduit 330 extends between the tank 304 and the rim 308. In this way, the second conduit 330 facilitates location of the heated water generator 118 remote from the toilet 300, such as within a closet or behind a wall.

The toilet 300 includes a heated water delivery channel 332. The heated water delivery channel 332 extends about the rim 308. In various embodiments, the heated water delivery channel 332 extends about the rim 308 proximate each of the rim apertures 312. The heated water delivery channel 332 is configured to deliver the heated water from the heated water generator 318 to clean the toilet 300. In particular, the heated water delivery channel 332 may be configured to deliver the heated water underneath the rim 308 and within the rim apertures 312. Contact between the heated water and the toilet 300 may sterilize the toilet 300 to kill germs associated with deposits (e.g., water deposits, waste deposits, mold, etc.) in the toilet. Additionally, where at least a portion of the heated water is steam, as the steam delivered to the toilet 300 condenses, the condensed steam may wash deposits into the bowl 314. In this way, the heated water cleaning system 302 may be utilized to mitigate accumulation of deposits within the toilet 300, thereby making the toilet 300 more desirable than other toilets which do not include the heated water cleaning system 302 and instead require manual cleaning or cannot be readily cleaned using only heated water.

The heated water generator 318 also includes a controller 334. The controller 334 is communicable with the water heater 322, the sensor 324, and the discharge valve 326. The controller 334 is configured to receive the parameter sensed by the sensor 324 and to control the water heater 322 and the discharge valve 326 based on the parameter. For example, the controller 334 may compare the temperature of water within the heated water generator tank 320 to a boiling point of water and control the water heater 322 based on the temperature of the water within the heated water generator tank 320 (e.g., if the temperature of the water within the heated water generator tank 320 is significantly below the boiling point of water, then the controller 334 may cause the water heater 322 to heat the water at a greater rate than if the temperature of the water within the heated water generator tank 320 is not significantly below the boiling point of water, etc.).

The heated water generator 318 also includes a fill valve 336 which is communicable with the controller 334. The fill valve 336 is communicable with the water supply conduit that provides water to the heated water generator tank 320 (e.g., from the tank water supply 307, etc.) and is configured to be controlled by the controller 334 to selectively fill the heated water generator tank 320 with water. For example, when the sensor 324 determines that a level of the water within the heated water generator tank 320 is below a threshold (e.g., a minimum amount of water within the heated water generator tank 320, etc.) the controller 334 may open the fill valve 336 until the level of the water within the heated water generator tank 320 is at or above the threshold.

The heated water generator 318 is defined by a heated water cleaning cycle. In some embodiments, the heated water cleaning cycle includes: turning on (e.g., activating, powering, starting, etc.) the water heater 322 to heat (e.g., boil, etc.) the water to produce heated water; using the sensor 324 to determine when a target amount of heated water is present within the heated water generator tank 320; opening the discharge valve 326 such that the heated water is provided to the heated water delivery channel 332 for a target period of time (e.g., a cleaning time, etc.); closing the discharge valve 326; turning off the water heater 322; opening the fill valve 336 to fill the heated water generator tank 320 with water such that a target amount of water is present within the heated water generator tank 320, as determined by using the sensor 324; and closing the fill valve 336. These embodiments may be referred to as "initially filled" heated water cleaning cycles because the first step is not opening the fill valve 336 to cause water to fill the heated water generator tank 320. In other embodiments, the heated water cleaning cycle includes: opening the fill valve 336 to fill the heated water generator tank 320 with water such that a target amount of water is present within the heated water generator tank 320, as determined by using the sensor 324; closing the fill valve 336; turning on the water heater 322 to heat the water such that the water is heated (e.g., boiled, etc.) to produce heated water; using the sensor 324 to determine when a target amount of heated water is present within the heated water generator tank 320; opening the discharge valve 326 such that the heated water is provided to the heated water delivery channel 332 for a target period of time; closing the discharge valve 326; and turning off the water heater 322. These embodiments may be referred to as "initially empty" heated water cleaning cycles because the first step is opening the fill valve 336 to cause water to fill the heated water generator tank 320.

The heated water generator 318 also includes a PRV 338. The PRV 338 is communicable with the heated water generator tank 320 and is configured to substantially prevent over pressurization of the heated water generator tank 320. For example, when a pressure of the heated water within the heated water generator tank 320 exceeds a threshold, the PRV 338 may purge heated water from the heated water generator tank 320 (e.g., release the heated water from the heated water generator tank 320 to atmosphere, etc.) until the pressure of the heated water within the heated water generator tank 320 is at or below the threshold. The PRV 338 may be communicable with an alarm that is configured to alert a user (e.g., via a whistle, via an indicator light, via a warning signal, via an audio signal, etc.) of a potential fault within the heated water generator 318 that could result in unintentional pressurization of the heated water generator tank 320.

The heated water generator 318 also includes an input/output device 340 that is communicable with the controller 334. The input/output device 340 may be a keypad, a touchscreen, a wired communication port (e.g., a USB port, etc.), a wireless communication device (e.g., a Bluetooth transceiver, a Bluetooth receiver, an NFC transceiver, an NFC receiver, a Wi-Fi transceiver, a Wi-Fi receiver, etc.), or other similar device. The input/output device 340 is configured to facilitate user interaction with the controller 334 (e.g., via a smartphone, via a laptop, via the internet, via manual interaction with the input/output device 340, etc.). In some embodiments, the input/output device 340 includes a button which may be depressed to initiate a heated water cleaning cycle (e.g., independent of any scheduled heated water cleaning cycles, etc.). In some embodiments, the input/output device 340 is remote from the toilet 300 (e.g., on a wall, on a mirror, etc.).

In various embodiments, the controller 334 facilitates scheduling cleaning of the toilet 300 using the heated water cleaning system 302. For example, the controller 334 may specify that the toilet 300 is to complete a heated water cleaning cycle (e.g., an initially filled heated water cleaning cycle, an initially empty heated water cleaning cycle, etc.) every so often (e.g., every week, every month, etc.). The input/output device 340 may be utilized by a user to specify that each day, at a target time (e.g., two o'clock in the morning, etc.), the controller 334 is to initiate a heated water cleaning cycle. In this way, the user may ensure that the toilet 300 is cleaned at time when usage of the toilet is not expected. A user may utilize the input/output device 340 to determine when the heated water generator system cleans the toilet 300, how much heated water is utilized to clean the toilet 300 (e.g., the user can select to utilize the "maximum" amount of heated water, the "minimum" amount of heated water, and other similar amounts, etc.), and other similar options.

In some embodiments, the controller 334 can control the water heater 322 such that the heated water provided to the toilet 300 has a target temperature. For example, it may desirable to clean the toilet 300 using higher temperature heated water every so often while cleaning the toilet 300 using lower temperature heated water at all other times, thus allowing the heated water cleaning system 302 to operate in an energy-efficient manner. For example, the controller 334 may alternate heated water cleaning cycles between a heated water cleaning cycle using higher temperature heated water and a heated water cleaning cycle using lower temperature heated water.

While not shown, it is understood that the controller 334 receives electricity (e.g., electrical power, electrical energy, etc.) from a source. For example, the controller 334 may be connected to a wall outlet (e.g., a 320 Volt AC outlet, etc.). In some embodiments, the heated water generator 318 includes a backup battery. The backup battery is configured to receive electricity from the source and to store the electricity for use by the heated water generator 318 in the event of a power outage at the source.

While not shown, the controller 334 may communicate with a sensor that is configured to determine a parameter associated with the toilet 300, rather than the sensor 324 which senses a parameter associated with the heated water generator 318. For example, the controller 334 may be communicable with an occupancy sensor, motion sensor, or infrared sensor that is configured to determine if a user is using the toilet 300. If the controller 334 determines that a user is using the toilet 300, the controller 334 may delay a heated water cleaning cycle (e.g., a previously scheduled heated water cleaning cycle, etc.) until a target period of time has elapsed since the controller 334 has determined the user is no longer using the toilet 300. In this way, the controller 334 may minimize the likelihood that a user will encounter heated water from the heated water cleaning system 302.

In some embodiments, the heated water generator 318 is configured to receive a treatment for treating the heated water produced by the heated water generator 318 prior to the heated water being provided to the toilet 300. For example, the heated water generator 318 may receive a scented treatment such that the heated water provided to the toilet provides a scent to the toilet 300. This scent may also impact air surrounding the toilet 300. In this way, the heated water generator 318 may provide an added functionality of providing the toilet 300 with a target aromatic enhancement. In other applications, the treatment may be a target cleaning agent. The target cleaning agent may be, for example, an anti-bacterial treatment that provides the heated water with additional anti-bacterial properties. In still other embodiments, the treatment may include a dye that is dispersed within the heated water such that when the heated water flows into the bowl 314, the dye colors the water within the bowl 314 (e.g., to leave a "recently cleaned" visual appearance, etc.). The treatment may be provided to the heated water generator 318 in the form of a capsule that is inserted into the heated water generator 318 (e.g., via a cartridge, etc.). In this way, different capsules could be purchased by a user and inserted in the heated water generator 318 to provide the heated water generator 318 with a target functionality. The heated water generator 318 may also include a separate tank for storing the treatment and mixing the treatment with the heated water (e.g., downstream of the discharge valve 326 but upstream of the second conduit 330, etc.).

In some embodiments, the controller 334 is configured to selectively operate the heated water generator 318 as a humidifier to humidify a room within which the heated water generator 318 is located. For example, the controller 334 may be configured to maintain a humidity within the room by generating steam and purging the steam to the room using the PRV 338. In these embodiments, the controller 334 may include an additional sensor for monitoring the humidity of the room. In some embodiments, the controller 334 is configured to selectively operate the heated water generator 318 to produce steam for warming towels. For example, the controller 334 may be scheduled to warm a towel or a plurality of towels every morning such that when a user uses a towel after a shower or bath, the towel has been warmed by the steam.

While not shown, it is understood that the heated water generator 318 may include various check valves to prevent backflow of air and/or fluid from the toilet 300 into the heated water generator 318. The heated water generator 318 may also include various filters (e.g., air filters, water filters, etc.) to ensure prolonged operation of the heated water cleaning system 302 with minimal maintenance.

While the toilet 300 has been primarily described and illustrated as a toilet which utilizes a water flush, it is understood that the heated water cleaning system 302 could be similarly implemented in waterless and low water toilets. In some embodiments, the discharge valve 326 is replaced with a pump that operates similar to the pump 126 previously described. Such a pump is communicable with the controller 334 and configured to be selectively turned on and turned off by the controller 334 to cause flow of heated water from the first conduit 328 to the second conduit 330. In various embodiments, the toilet 300 does not include a pump (e.g., a pump similar to the pump 126, etc.).

Figure 4:
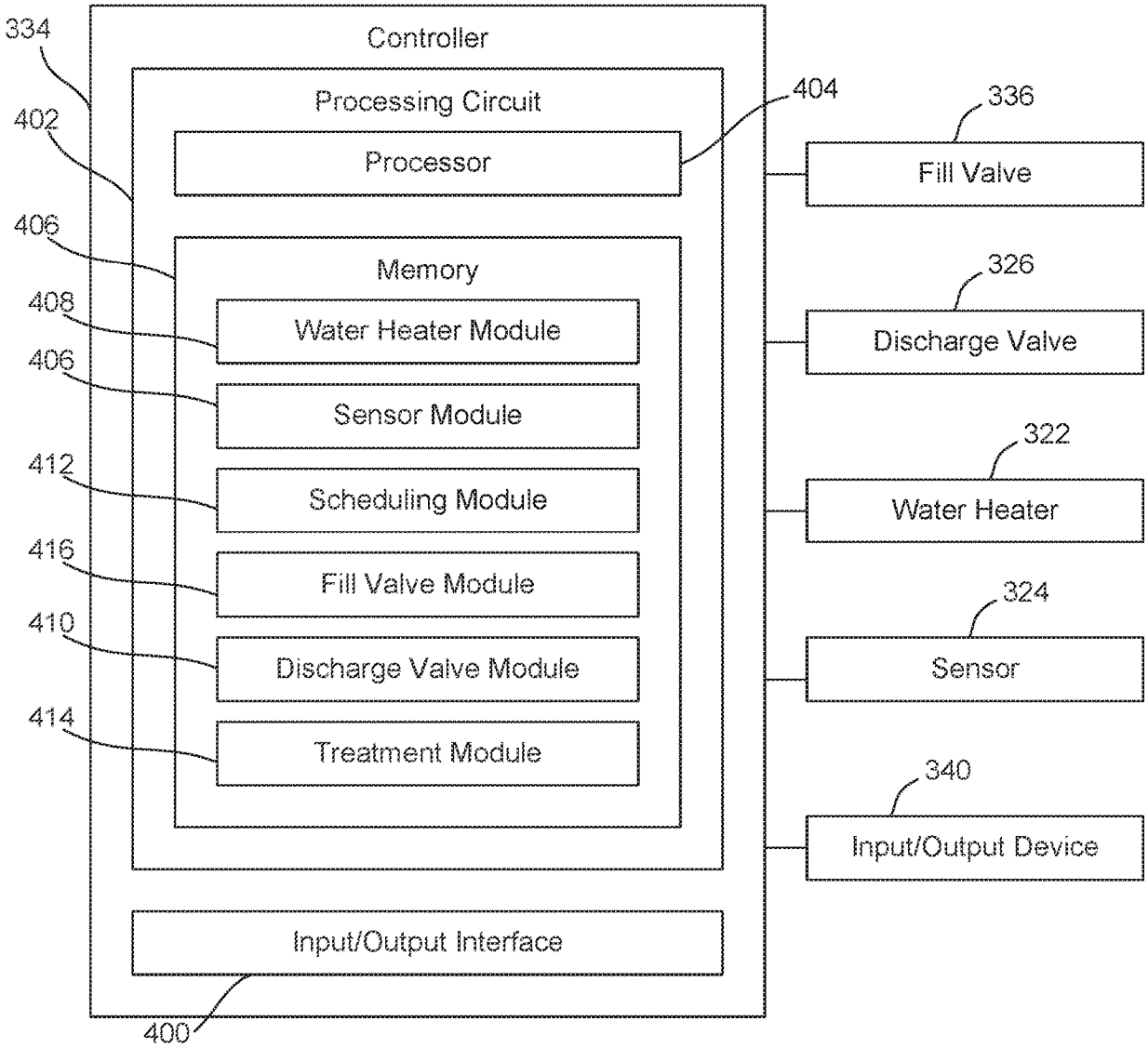
FIG. 4 is a block diagram of a control system for the heated water cleaning system shown in FIG. 3, according to an exemplary embodiment of the present disclosure.

FIG. 4 illustrates the controller 334 in greater detail. The controller 334 is electronically communicable with the water heater 322, the sensor 324, the discharge valve 326, the fill valve 336, and the input/output device 340. The controller 334 is configured to control the water heater 322, the sensor 324, the discharge valve 326, and the fill valve 336 to complete a heated water cleaning cycle, such as in response to a request for a heated water cleaning cycle received by the input/output device 340.

The controller 334 includes an input/output (I/O) interface 400 and a processing circuit 402. The input/output interface 400 facilitates interaction between the processing circuit 402 and the water heater 322, the sensor 324, the discharge valve 326, the fill valve 336, and the input/output device 340. The processing circuit 402 includes a processor 404 and a memory 406. The memory 406 may include, but is not limited to, electronic, optical, magnetic, or any other storage or transmission device capable of providing the processor 204 with program instructions. The memory 406 may include a memory chip, electrically erasable programmable read-only memory, erasable programmable read only memory, flash memory, or any other suitable memory from which the modules can read instructions. The instructions may include code from any suitable programming language.

The memory 406 includes a number of modules (e.g., microprocessors, application-specific integrated circuit, field-programmable gate arrays, etc.). As shown in FIG. 4, the memory 406 includes a water heater module 408, a discharge valve module 410, a scheduling module 412, a treatment module 414, and a fill valve module 416. The water heater module 408 is configured to control interactions between the controller 334 and the water heater 322. The discharge valve module 410 is configured to control interactions between the controller 334 and the discharge valve 326. The scheduling module 412 is configured to control interactions between the controller 334 and the input/output device 340. The treatment module 414 is configured to facilitate interaction between the controller 334 and any device of the heated water generator 318 which receives a cartridge having a treatment contained therein. The fill valve module 416 is configured to control interactions between the controller 334 and the fill valve 336.

IV. Configuration of Exemplary Embodiments

As utilized herein, the terms "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims. It is understood that the term "prevent" is intended to encompass de minimus variations as would be understood to be within the scope of the disclosure by those of ordinary skill in the art.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure.

The terms "coupled," "connected," "fastened," "attached," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," "upper," etc.) are merely used to describe the orientation of various elements in the FIGURES. It should be noted that the orientation of various elements may differ according to other exemplary embodiments and that such variations are intended to be encompassed by the present disclosure.

The construction and arrangement of the elements of the heated water cleaning system 102, the heated water cleaning system 302, and all other elements and assemblies as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Other substitutions, modifications, changes, and omissions may also be made in the design, operating conditions, and arrangement of the various exemplary embodiments without departing from the scope of the present invention. For example, any element disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes, and omissions may be made in the design, operating configuration, and arrangement of the preferred and other exemplary embodiments without departing from the scope of the appended claims.

Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

What is claimed is:

1. A toilet comprising:

a basin comprising a bowl;

a rim comprising a rim aperture in fluid communication with the bowl; and a heated water cleaning system comprising:

a heated water delivery channel positioned proximate the rim aperture;

a heated water generator in fluid communication with the heated water delivery channel, the heated water generator configured to receive water, produce heated water, and provide the heated water to the heated water delivery channel, the heated water generator comprising:

a heated water generator tank configured to contain at least one of water or heated water; and a heater positioned within the heated water generator tank;

a sensor disposed within the heated water generator tank and configured to sense a parameter of the at least one of the water or the heated water in the heated water generator tank;

a fill valve configured to selectively provide water into the heated water generator tank; and a controller communicable with the sensor and the fill valve;

wherein the controller is configured to control the fill valve based on the parameter.

2. The toilet of claim 1, wherein:

the heated water generator is external to the toilet; and the heated water cleaning system further comprises a conduit configured to provide heated water from the heated water generator tank to the heated water delivery channel.

3. The toilet of claim 2, further comprising a tank disposed on top of the basin, the tank configured to receive water, provide the water to the bowl, and contain a tank water supply.

4. The toilet of claim 3, wherein the toilet is configured such that the tank receives water independent of the heated water generator and the heated water generator receives water independent of the tank.

5. The toilet of claim 2, wherein the heated water cleaning system further comprises a pump configured to selectively draw the at least one of the water or the heated water from the heated water generator tank and provide the at least one of the water or the heated water to the conduit.

6. The toilet of claim 5, wherein the controller is communicable with the heater and the pump and configured to control at least one of the heater or the pump, based on the parameter.

7. The toilet of claim 2, wherein the heated water cleaning system further comprises a pressure relief valve coupled to the heated water generator tank and configured to selectively purge at least one of air, the water, or the heated water, from the heated water generator tank.

8. The toilet of claim 1, further comprising a tank disposed on top of the basin, the tank comprising a tank water supply;

wherein the heated water generator is contained within the tank; and wherein the heated water generator tank is coupled to the tank water supply.

9. The toilet of claim 8, further comprising:

a conduit coupled to the tank and the heated water generator tank; and the fill valve disposed along the conduit and configured to selectively facilitate passage of a portion of the tank water supply to the heated water generator tank.

10. The toilet of claim 9, wherein the fill valve is configured to selectively isolate the tank from the heated water generator tank such that passage of a portion of the tank water supply to the heated water generator tank is prohibited.

11. The toilet of claim 9, further comprising a discharge valve coupled to the heated water delivery channel and the heated water generator tank and configured to selectively cause the at least one of the water or the heated water contained in the heated water generator tank to be provided to the heated water delivery channel.

12. The toilet of claim 9, further comprising:

the controller communicable with the heater, and the sensor and configured to control the heater based on the parameter.

13. The toilet of claim 9, further comprising a pressure relief valve coupled to the heated water generator tank and configured to selectively purge at least one of air, the water, or the heated water, from the heated water generator tank.

14. A system for a toilet having a bowl and a rim, the rim having a rim aperture that is in fluid communication with the bowl and a heated water delivery channel positioned proximate the rim aperture, the system comprising:

a heated water generator configured to be in fluid communication with the heated water delivery channel, the heated water generator configured to receive water, produce heated water, and provide the heated water to the heated water delivery channel, the heated water generator comprising:

a heated water generator tank configured to contain at least one of water or heated water; and a heater positioned within the heated water generator tank;

a sensor disposed within the heated water generator tank and configured to sense a parameter of the at least one of the water or the heated water in the heated water generator tank;

a fill valve configured to selectively provide water into the heated water generator tank; and a controller communicable with the sensor and the fill valve, wherein the controller is configured to control the fill valve based on the parameter.

15. The system of claim 14, further comprising a conduit configured to fluidly couple the heated water generator and the heated water delivery channel;

wherein the heated water generator is coupled to the toilet only via the conduit.

16. The system of claim 14, further comprising:

a pump configured to selectively draw the at least one of the water or the heated water from the heated water generator tank;

wherein the controller is communicable with the heater the pump, and configured to control at least one of the heater or the pump, based on the parameter.

17. A toilet comprising:

a basin comprising a bowl;

a tank;

a rim comprising a rim aperture in fluid communication with the bowl, the rim aperture configured to receive water from the tank and provide the water from the tank into the bowl; and a heated water cleaning system comprising:

a heated water generator tank configured to contain water separate from the tank; and a heated water delivery channel positioned proximate the rim aperture and in fluid communication with the rim aperture, the heated water delivery channel configured to provide water from the heated water generator tank to the rim aperture;

wherein the rim aperture is configured to receive the water from the heated water delivery channel and provide the water from the heated water delivery channel into the bowl;

a sensor disposed within the heated water generator tank and configured to sense a parameter of the at least one of the water or the heated water in the heated water generator tank;

a fill valve configured to selectively provide water into the heated water generator tank; and a controller communicable with the sensor and the fill valve, wherein the controller is configured to control the fill valve based on the parameter.

18. The toilet of claim 17, further comprising:

a heater positioned within the heated water generator tank and configured to heat the water within the heated water tank;

wherein the controller is communicable with the heater and configured to control the heater based on the parameter.

19. The toilet of claim 17, wherein the heated water generator tank is contained within the tank.

* * * * *